US007516831B2

(12) United States Patent
Chang

(10) Patent No.: US 7,516,831 B2
(45) Date of Patent: Apr. 14, 2009

(54) COIN-OPERATED ITEM VENDING AND GAME APPARATUS HOUSING WITH FOREIGN OBJECT REMOVAL-ENABLING MEANS

(76) Inventor: Kil Jae Chang, T.PiCo. Korea Co., Ltd., 321-37 Suksu, 2 Dong, Anyang City, Kyungkio (KR)

( * ) Notice: Subject to any disclaimer, the term of this patent is extended or adjusted under 35 U.S.C. 154(b) by 490 days.

(21) Appl. No.: 11/335,947

(22) Filed: Jan. 20, 2006

(65) Prior Publication Data

US 2007/0108014 A1 May 17, 2007

Related U.S. Application Data

(60) Provisional application No. 60/736,357, filed on Nov. 14, 2005.

(51) Int. Cl.
*G07F 1/04* (2006.01)

(52) U.S. Cl. ..... 194/347; 194/344; 194/352; 273/355; 463/48; 221/123

(58) Field of Classification Search ..... 194/293, 194/317, 344, 347, 352; 221/120–123, 217, 221/218, 220–223, 273; 273/355, 383, 399, 273/448; 463/48

See application file for complete search history.

(56) References Cited

U.S. PATENT DOCUMENTS

| | | | | |
|---|---|---|---|---|
| 1,466,372 | A | 8/1923 | Giles | |
| 1,572,090 | A | 2/1926 | Smith | |
| 1,842,243 | A | 1/1932 | Boyer | |
| 2,044,320 | A | 6/1936 | Norris | 273/143 |
| 2,050,678 | A | 8/1936 | Weber | 194/97 |
| 2,738,049 | A | 3/1956 | Shepherd | 194/1 |
| 3,100,034 | A | 8/1963 | Spohrer | 194/1 |
| 3,572,703 | A | 3/1971 | Greene | 273/1 |
| 5,417,435 | A | 5/1995 | Peretz | 273/355 |
| 6,270,080 | B1 | 8/2001 | Chang | 273/399 |
| 6,695,698 | B1 | 2/2004 | Anghelo et al. | 463/25 |

*Primary Examiner*—Jeffrey A Shapiro
(74) *Attorney, Agent, or Firm*—John R. Flanagan

(57) ABSTRACT

Foreign object removal-enabling features in a coin-operated item vending and game apparatus housing include a shallow V-shaped guard wall extending between a pair of opposing sidewalls of a lower end portion of the housing, a pair of openings each in one of the opposing sidewalls adjacent opposite ends of the guard wall, and another opening in a front wall of the housing below and in front of the guard wall. The guard wall is positioned to block debris, such as pieces of paper, from traveling on a path to a coin slot of a coin deposit while providing a slot in the guard wall for permitting a coin to pass through the guard wall to the coin slot. The wall openings will permit insertion a tweezers or other tool therethrough enable the debris removal.

20 Claims, 4 Drawing Sheets

COIN-OPERATED ITEM VENDING AND GAME APPARATUS HOUSING WITH FOREIGN OBJECT REMOVAL-ENABLING MEANS

This patent application claims the benefit of U.S. provisional application No. 60/736,357, filed Nov. 14, 2005.

BACKGROUND OF THE INVENTION

1. Field of the Invention

The present invention generally relates to vending and game machines and, more particularly, is concerned with a coin-operated item vending and game apparatus housing with foreign object removal-enabling means.

2. Description of the Prior Art

Coin-operated vending machines, such as gum ball machines, have been popular for many years. Also, coin-operated vending machines are known having games associated with them.

U.S. Pat. No. 6,270,000, which issued Aug. 7, 2001 to the inventor of the present invention, discloses a coin-operated item vending and game apparatus which combines an item vending machine, such as a gum ball machine, and a game module in a more effective way to encourage use of the apparatus. The embodiment of the apparatus illustrated in the patent, following issuance of the patent, was modified in minor respects during the construction of a more refined version of the apparatus which was then introduced for sale and commercial use, more than one year before the filing date of the above cited provisional application. It will be readily observed by comparing FIGS. 1 and 2 herein, illustrating the commercial version of the apparatus, with the same figures of the cited patent that the commercial version retains the same combination of the item vending machine and game module and is substantially similar overall to the embodiment of the patent.

The combined item vending machine and game module of the apparatus allows a user to attempt in the game module of the apparatus to shoot or toss a coin to make a target by the coin passing through the target. Also, the apparatus has a mechanism to enable the user to prove that the target was made in case the proprietor of the apparatus has offered a prize for such accomplishment. The coin thereafter is routed to the item vending machine of the apparatus where it is used to obtain a vendable item whether the target was made or missed. The game module has attracted many users and has contributed substantially to the overall success of the apparatus.

However, as often happens in the case of many successful products, a small number of mischievous users from time to time have caused problems by attempting to play the game module without paying to play. These users typically attempt to circumvent the necessity to insert a coin to play by, instead, inserting a foreign object, such as folded piece of paper or the like, through a coin slot provided in a wall of the apparatus housing to a launch site on a flexible resilient lever of the game module intended to seat the required coin ordinarily inserted to such site. Then, such users actuate the lever to try to toss or shoot the foreign object so as to make the target with the foreign object.

Typically, the problem resulting from this kind of mischievous activity is not the loss of vendable items from the apparatus as the foreign object is usually incapable of replicating the function of a coin in a coin deposit of the apparatus which would enable the actuation of the vending machine of the apparatus and the vending the desired item, for instance a gum ball, to a legitimate user. Instead, the resultant problem is that the foreign object will typically fall downward along a narrowing path in the game module, one normally traveled by the coin after the game module has been played, leading from the game module to the coin deposit where the foreign object then stops and creates an obstruction or blockage of the coin deposit, preventing the coin from a succeeding user to reach the coin deposit and ultimately to receive the desired vended item.

Unfortunately, the occurrence of this kind of problem was not anticipated and so it is not possible to remove the obstructing foreign object(s) without first disassembling the globe and game module housing of the apparatus from its support base. Consequently, a need has arisen for an innovation to provide a solution to the aforementioned problem without introducing any new problems in place thereof.

SUMMARY OF THE INVENTION

The present invention provides foreign object removal enabling means designed to satisfy the aforementioned need. The foreign object removal enabling means is provided on a housing of a coin-operated item vending and game apparatus which facilitate convenient and easy access to any foreign object therein so that the obstructing foreign object may be readily and easily removed without needing to disassemble the housing of the apparatus from its support base.

Accordingly, the present invention is directed to a game module for a coin-operated item vending machine, the game module comprising: (a) a housing having one slot defined therein for permitting discharge of the coin from the housing; and (b) means for enabling removal of a foreign object from within the housing, the removal-enabling means including (i) a guard wall positioned within the housing above the one slot and extending across a path of travel of the coin to the one slot such that the guard wall can stop a foreign object from traveling on a portion of the path of travel from an upstream side to a downstream side of the guard wall and therefrom to the one slot, the guard wall also including another slot having a maximum dimension greater than a maximum dimension of the coin for permitting the coin to pass through the guard wall from the upstream side to the downstream side thereof and therefrom to the one slot, and (ii) at least one opening defined in the housing adjacent one end of the guard wall and the upstream side of the guard wall such that the one opening will permit withdrawal of the foreign object from the housing, the one opening having a maximum dimension less than the maximum dimension of the coin such that the coin cannot be withdrawn from the housing through the one opening.

More particularly, the guard wall has a generally upright lower segment and a forwardly and upwardly inclined upper segment merging from the lower segment and together defining a shallow V-shaped angular configuration in cross-section. The another slot is defined in the upright lower segment of the guard wall. Further, the housing has a pair of spaced apart opposite side walls and the guard wall extends between and is connected at opposite ends to the side walls. Also, the removal-enabling means includes another opening such that the one and another openings are each defined in one of the side walls of the housing.

The removal-enabling means further includes a second opening in the housing below and spaced from the downstream side of the guard wall such that the second opening permits withdrawal of a foreign object from the housing which passed through the another slot in the guard wall. Furthermore, the housing has multiple walls in a funnel-shaped configuration. The guard wall extends across and interconnects the multiple walls and the second opening is defined in one of the multiple walls spaced from and at least partially below the guard wall.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Prior Art Commercial Version of Apparatus

Figure 1:
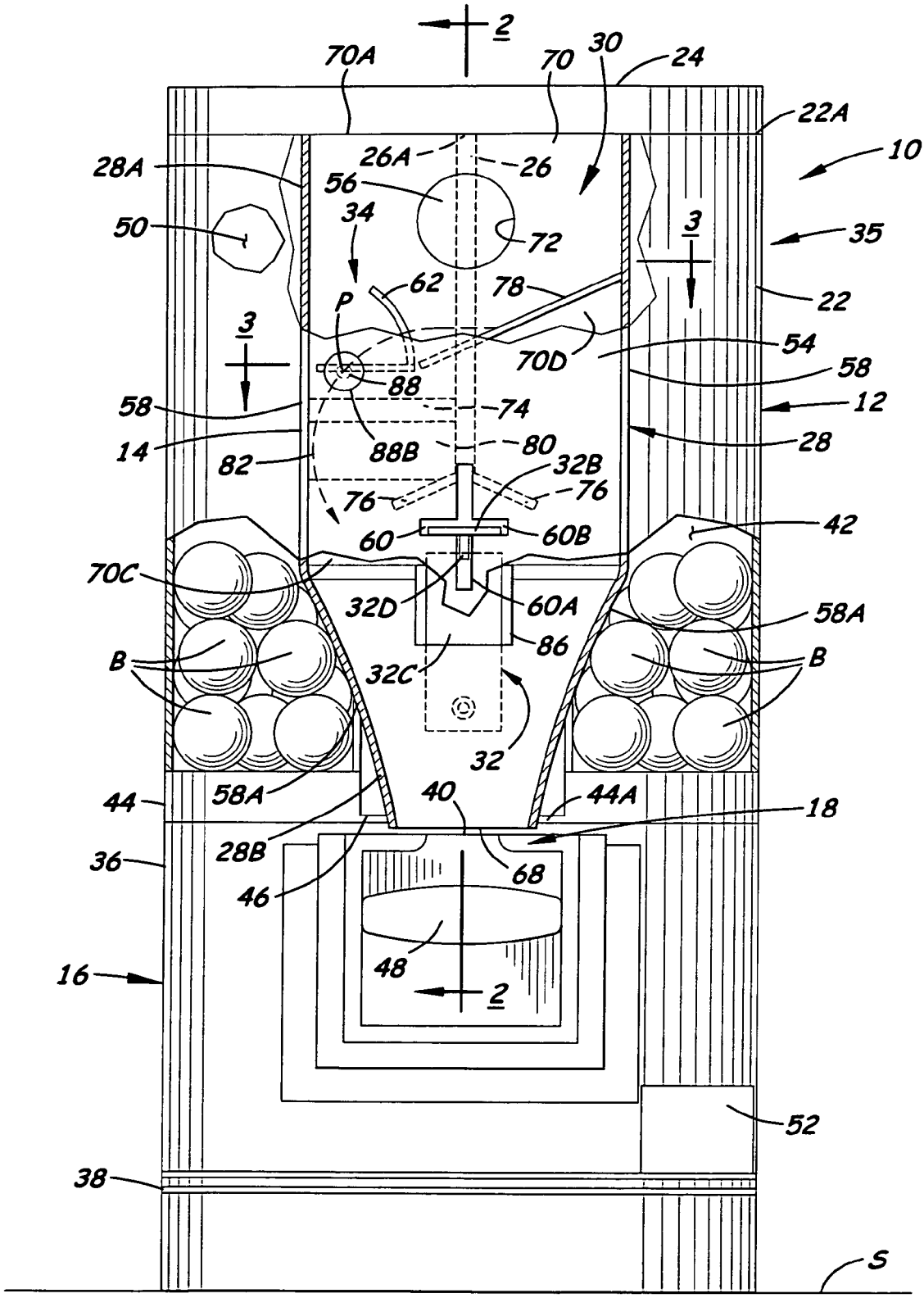
Fig. 1 (PRIOR ART)
FIG. 1 is a front elevational view of a prior art coin-operated item vending and game apparatus.
Figure 2:
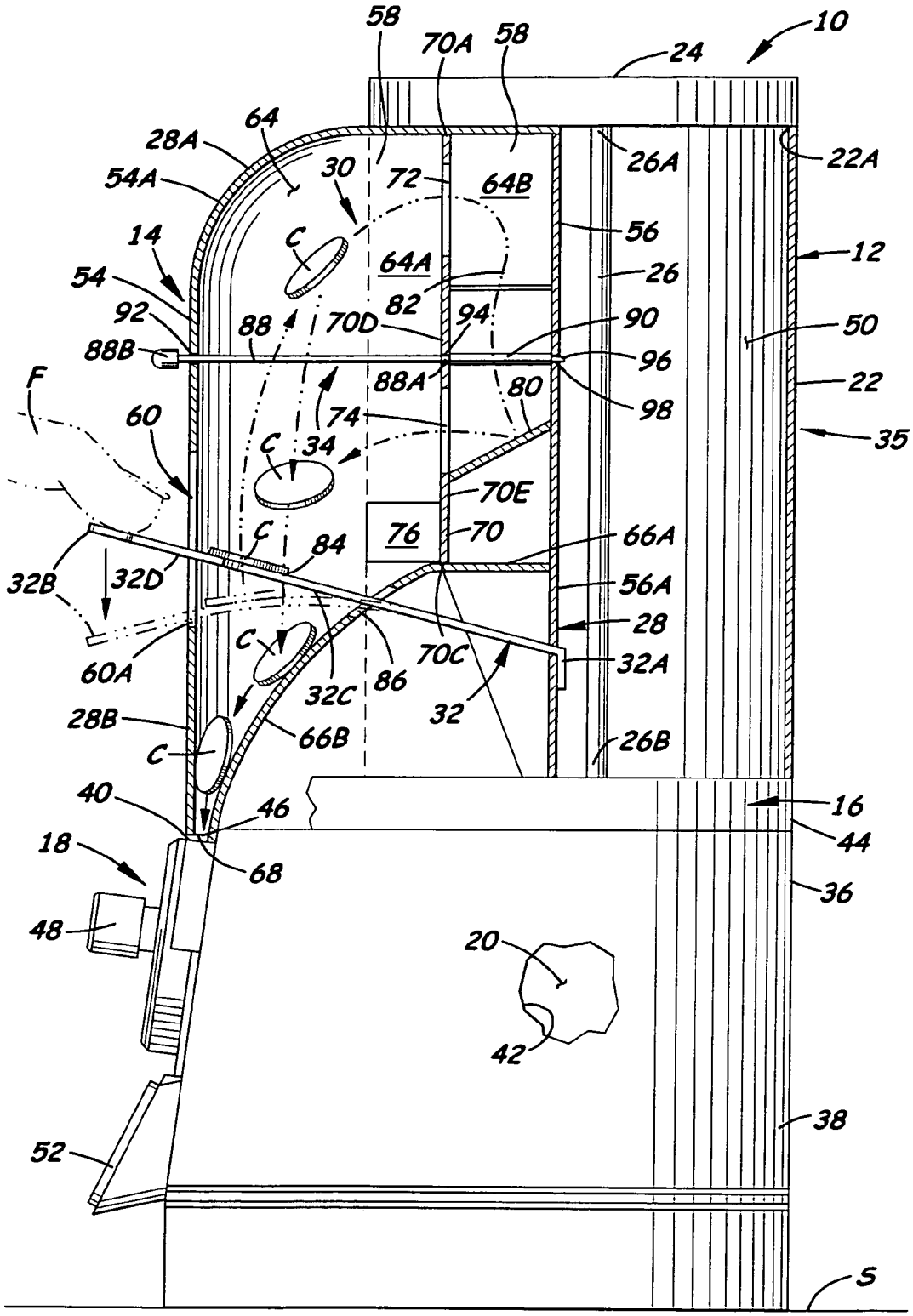
Fig. 2 (PRIOR ART)
FIG. 2 is a side elevational view of the prior art apparatus of FIG. 1, with a vending machine globe and a game module housing of the apparatus being shown in a vertically sectional form as seen along line 2-2 of FIG. 1.

Referring to FIGS. 1 and 2 of the attached drawings, there is illustrated the aforementioned prior art commercial version of the coin-operated item vending and game apparatus, generally designated 10, the apparatus being depicted prior to application of the features of the present invention that solve the aforementioned problem. The apparatus 10 basically includes a coin-operated item vending machine 12 and a game module 14. The vending machine 12 basically includes a support base 16, a coin deposit 18, an item dispenser 20, a globe 22, a lid 24 and an elongated central rod-like support member 26. The game module 14 basically includes a housing 28, a target 30, a flexible resilient lever 32, and a coin capture and release mechanism 34. It should be understood that the vending machine globe 22 and game module housing 28 can be considered together as forming a unitary housing 35 of the apparatus 10.

The support base 16 of the vending machine 12 has a top portion 36 and a bottom portion 38 merging downward from the top portion 36 for resting the machine 12 on a suitable surface S. The coin deposit 18 of the vending machine 12 is mounted to the exterior of the top portion 36 of the support base 16 and defines an upwardly-open coin-receiving slot 40. The support base 16 preferably, although not necessarily, has a generally polygonal configuration and defines an interior chamber 42 for retaining coins C therein and being open so as to receive therein the vendable item dispenser 20 of the machine 12 such that the item dispenser 20 extends downward through the top portion 36 of the support base 16. The item dispenser 20 is suspended below an upper tray 44 which, in turn, seats upon the top portion 36 of the support base 16 and closes the same. The upper tray 44 has a opening 46 defined in a front peripheral portion 44A thereof which is spaced above and generally overlies the coin-receiving slot 40 of the coin deposit 18. The upper tray opening 46 has a configuration which generally conforms to that of the coin-receiving slot 40 and the coin C such that the coin C may drop through the opening 46 and into the slot 40. The coin deposit 18 also has a knob 48 rotatable to drop the coin C from the slot 40 into the interior chamber 42 of the support base 16. Also as is well-known, a suitable receptacle (not shown) is removably mounted to the support base 16 so as to extend within its interior chamber 42 for collecting coins dropped from the slot 40 into the interior chamber 42 of the support base 16. At intervals selected by the owner of the apparatus 10, the receptacle may be removed from the support base 16 in order to retrieve the contents thereof.

The globe 22 of the vending machine 12 is comprised of a substantially transparent material and preferably, although not necessarily, has a polygonal shape, such as a composite rectangular and trapezoidal configuration, which seats upon a complementarily-configured upper portion of the upper tray 44 and extends thereabove. The lid 24 of the vending machine 12 has a configuration complementary to that of the globe 22 such that the lid 24 removably mounts to an open upper end 22A of the globe 22 and thereby closes the globe 22 at such upper end 22A. The support member 26 of the vending machine 12 is disposed centrally within the globe 22 and has opposite upper and lower ends 26A, 26B whereby the support rod 26 connects at its upper end 26A to the lid 24 and mounts at its lower end 26B to the dispenser 20. The lid 24 has suitable means for releasably latching it to the upper end 26A of the support rod 26. The globe 22 defines an interior cavity 50 which cooperates with the upper tray 44 and the item dispenser 20 to receive and retain a plurality of vendable items, such as spherically-shaped gum balls B. The dispenser 20 allows for passage of these items one at a time from the interior cavity 50 to the exterior of the support base 16 in response to rotation of the knob 48 of the coin deposit 18. The dispenser 20 includes a carrier wheel (not shown) having peripheral slots (not shown) of a size allowing only one item at a time to pass therethrough to an outlet on the exterior of the support base 16 covered by a door 52 hingedly mounted to the support base 16 which is normally closed but openable by a user to gain access to the item vended from by dispenser 20.

The housing 28 of the game module 14 is also made of a substantially transparent material and is partially positioned within the interior cavity 50 of the globe 22 of the vending machine 12. The game module housing 28 has a size smaller than the globe 22 and is affixed to and positioned within the globe 22 so as to also project forwardly from the globe 22 so as to serve a dual purpose, to function as the front portion of the globe 22 as depicted in the cited patent and the front portion of the housing 28. The housing 28 has opposite upper and lower end portions 28A, 28B, opposite front and back walls 54, 56 and opposite side walls 58 extending between and interconnecting the front and back walls 54, 56. The front wall 54 is disposed adjacent to and forwardly of the globe 22 and has a slot 60 defined therein having vertical and horizontal portions 60A, 60B crossing one another. The vertical portion 60A has a height greater than its width. The width of the vertical portion 60A is less than the length and greater than the height of the horizontal portion 60B. The back wall 56 is disposed adjacent to the support member 26 and has an arcuate-shaped slot 62 defined therein.

The front, back and side walls 54, 56, 58 of the housing 28 together define therebetween an interior cavity 64. The front wall 54 at its upper portion 54A curves rearwardly so as to enclose the top of the interior cavity 64 at the upper end portion 28A of the housing 28, whereas a bottom wall 66 of the housing 28 curves forwardly substantially parallel with the upper portion 54A of the front wall 54 so as to enclose the bottom of the interior cavity 64 at the lower end portion 28B of the housing 28. The front, side and bottom walls 54, 58, 66 of the housing 28 also converge toward one another so as to provide the lower end portion 28B of the housing 28 with a funnel-like configuration that extends downwardly through the opening 46 defined in the front peripheral portion 44A of the upper tray 44. The lower end portion 28B of the housing 28 then terminates to form a slot 68 having substantially the same size and configuration as and being disposed above the slot 40 of the coin deposit 18 so as to allow for passage of the coin C through the lower end portion 28B of the housing 28 into the slot 40. The lower funnel-like configuration of the housing 28 guides the coin C through the slot 68 of its lower end portion 28B such that the coin C is delivered in the appropriate orientation to the slot 40 of the coin deposit 18.

The target 30 of the game module 14 is disposed within the interior cavity 64 of and is mounted to the housing 28. The target 30 includes an intermediate wall 70 that extends between the side walls 58, the curved upper portion 54A of the front wall 54 and the flat rear portion 66A of the bottom wall 66 and interconnects with the same so as to partition the interior cavity 64 of the housing 28 into front and rear chambers 64A, 64B. The intermediate wall 70 has a scoring aperture 72, generally circular in shape to simulate a basketball hoop, defined therein adjacent to and spaced a short distance below its upper edge 70A. The intermediate wall 70 also has an opening 74, generally rectangular in shape, defined therein adjacent its left vertical edge 70B and the left one of the side walls 58 of the housing 28, when viewing the same from its front, approximately midway between the upper edge 70A and a bottom edge 70C of the housing 28. The intermediate wall 70 further has an inverted V-shaped roof-shaped structure 76 attached to a front face 70D of the intermediate wall 70 and projecting forwardly therefrom. The function of this structure 76 will become apparent below. Additionally, upper and lower ramp structures 78, 80 are spaced vertically and offset from one another and both affixed between a rear face 70E of the intermediate wall 70 and the rear wall 56 and respective ones disposed adjacent to and affixed to corresponding respective ones of the side walls 58 of the housing 28 such that a path 82 is defined for a scoring coin C to take through the target 30. The path 82 extends: first, rearwardly from the front chamber 64A to the rear chamber 64B of the interior cavity 64 through the scoring aperture 72 of the intermediate wall 70; second, downwardly to the right-to-left downwardly sloping upper ramp structure 78; third, continuing downwardly to the back-to-front downwardly sloping lower ramp structure 80; fourth, forwardly from the rear chamber 64B to the front chamber 64B through the opening 74 of the intermediate wall 70; and, finally, downwardly through the funnel-like lower end portion 28B of the housing 28. Pictures and the like, such as of a basketball player, and instructions may be provided on the housing 28 and globe 22 to enhance usage of the apparatus 10.

The lever 32 of the game module 14 is elongated and has a substantially flat rectangular configuration. The lever 32 has opposite inner and outer ends 32A, 32B and at an intermediate portion 32C between its ends 32A, 32B defines means thereon, such as an arcuate raised lip 84, for retaining a coin C. The lever 32 at its inner end 32A is fixedly attached to the back wall 56 of the housing 28 adjacent and above a lower end 56A thereof. From such location the lever 32 extending in a forwardly and upwardly inclined orientation below the flat rear portion 66A of the bottom wall 66 and then through an opening 86 in the bottom wall 66 located below the aforementioned roof-shaped structure 76 on the front face 70D of the intermediate wall 70. The structure 76 overlies and shields the opening 86 so as to prevent a coin which either misses or makes the target 30 from falling through the opening 86. Next, the lever 32 continues along the inclined orientation extending across the front chamber 64A of the interior cavity 64 of the housing 28 above and away from the curved bottom wall 66 thereof. Finally, the lever 32 extends through vertical portion 60A of the slot 60 in the front wall 54 of the housing 28 such that the outer end 32B of the lever 32 is disposed exteriorly of the housing 28, with the coin retaining lip 82 being located interiorly of the front wall 54. The portion 32D of the lever 32 extending through the vertical portion 60A of the slot 60 is substantially reduced in width, compared to the remaining width of the lever 32 so as to conform the lever 32 to the narrow width of the vertical portion 60A of the slot 60. The horizontal portion 60B of the slot 60 in the front wall 54 of the housing 28 has a size greater than the diameter and thickness of the coin C so as to allow for manual inserting by an user of the coin C therethrough such that the coin C can be placed at rest on the lever 32 adjacent to the lip 32 thereon.

The outer end 32B of the lever 32 is for gripping by one or more fingers F of a hand of the user and is depressible downwardly by the user bending the resilient flexible lever 32 from an initial relaxed inclined condition shown in solid line form in FIG. 2 to the depressed dashed line condition shown in FIG. 2. Such bending of the lever 32 creates an upward force because of the resiliency of the lever 32 such that the subsequent release of the lever 32 by the user allows the lever 32 to spring back to its initial relaxed condition and toss the coin C upwardly such the coin C will either go through (make) or miss the scoring aperture 72 of the target 30 depending on the skill of the user. The coin C upon missing the aperture 72 of the target 30 will fall down through the front chamber 64A of the interior cavity 64 onto the bottom wall 66 and be guided by the lower end portion 28B of the housing 28 into the slot 40 of the coin deposit 18 of the vending machine 12 causing the dispensing of the vendable item B to the user at the door 52 of the dispenser 20 upon rotation of the knob 48 of the coin deposit 18 by the user. On the other hand, if the coin C goes through or makes the aperture 72 of the target 30 it will follow the path 82 as described above.

As seen in FIGS. 1-4, the coin capture and release mechanism 34 of the game module 14 is associated with the target 30. The mechanism 34 includes an elongated member 88 having a substantially rod-like configuration for most of its length and opposite inner and outer ends 88A, 88B. The mechanism 88 also includes a coin target or retention plate 90 attached adjacent the inner end 88A of the elongated member 88 and having a substantially flat rectangular configuration which substantially conforms in size to the space defined between a lower end 78A of the upper ramp 78, left side wall 58 and back wall 56 of the housing 28 and the intermediate wall 70 of the target 30. The elongated member 88 extends through holes 92, 94 aligned with one another and defined respectively in the front wall 54 of the housing 28 and the intermediate wall 70 of the target 30.

Figure 3:
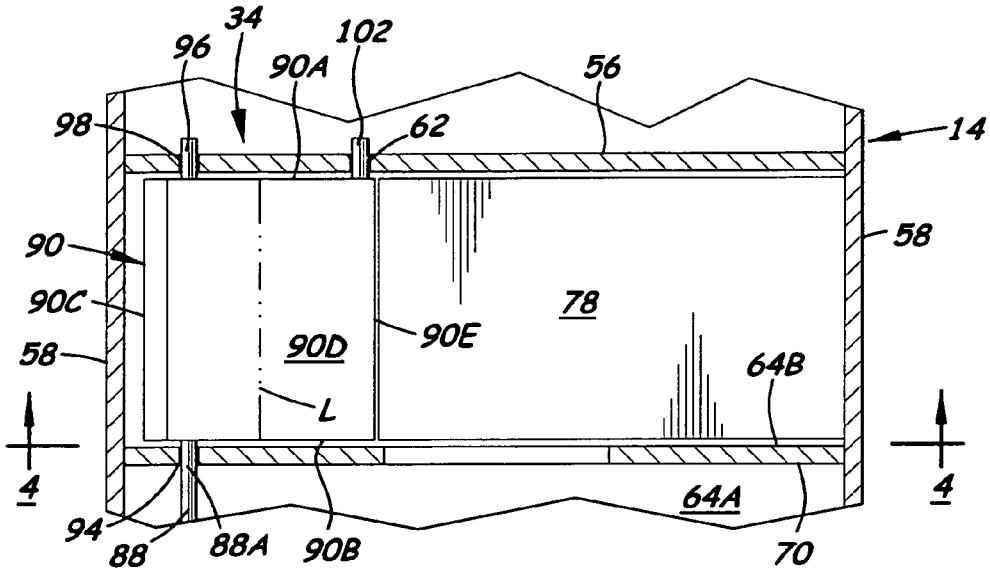
Fig. 3 (PRIOR ART)
FIG. 3 is an enlarged plan view of a prior art coin capture and release mechanism of the prior art apparatus positioned in the game module housing thereof being shown in a fragmentary sectional form as seen along line 3-3 of FIG. 2.
Figure 4:
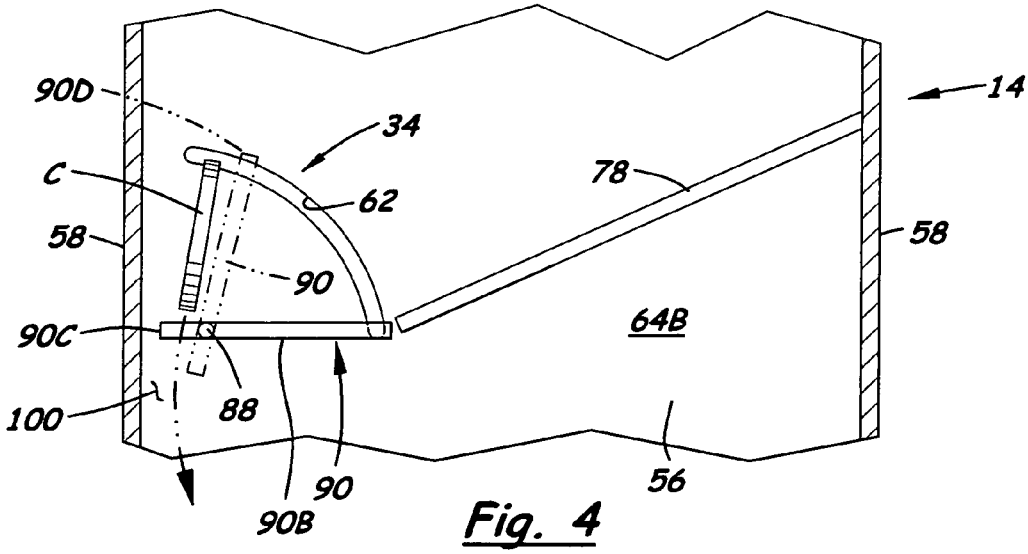
Fig. 4 (PRIOR ART)
FIG. 4 is a front elevational view of the prior art mechanism of FIG. 3 as seen along line 4-4 of FIG. 3.

As best seen in FIGS. 3 and 4, a stub axle 96 is affixed to a rear edge 90A of the retention plate 90 and extends through a hole 98 in the back wall 56 of the housing 28 in alignment with the holes 92, 94 and also in alignment with the elongated member 88 so as to define a pivot axis P of the plate 90 extending between rear and front edges 90A, 90B of the plate 90 such that when the elongated member 88 of the mechanism 30 is respectively rotated and counter-rotated about its own central axis which is coaxial with the pivot axis P of the plate 90, the plate 90 correspondingly is pivotally moved between a horizontal position and a vertical position for correspondingly closing (or blocking) and opening the path 82 for a scoring coin C to travel along through the target 30. The pivot axis P of the plate 90 is located parallel to and spaced a short distance inwardly from a left edge 90C of the plate 90 such that, with a coin C resting on an upper surface 90D of the plate 90, when the plate 90 is pivoted from the horizontal to vertical position a narrow gap 100 is created between the plate 90 and the left side wall 58 of the housing 28 through which the coin can slide edgewise from the plate 90, dropping downwardly therefrom onto the lower ramp 80 where it will continue along the path 82 into the front chamber 64A of the interior cavity 64 of the housing 28. The retention plate 90 also has a tab 102 affixed to a rear corner 90E of the retention plate 90, opposite from the stub axle 96, and extending through and resting on the lower end 62A of the arcuate slot 62 in the back wall 56 such that the tab 102 functions to hold the plate 90 in its normal horizontal blocking position unless a user grips the outer end 88B of the elongated member 88 located at the exterior of the front wall 54 of the housing 28 and causes it to rotate and the plate 90 to thereby pivotally move from the horizontal to vertical position. The arcuate-shaped slot 62 permits the tab 102 to move therealong and allow the pivoting of the plate 90 between its horizontal and vertical positions. The plate 90 is normally in the horizontal position blocking the path 82 such that the scoring coin C when tossed through the scoring aperture 72 will land on the plate 90 and stay there until the user intentionally pivots the plate 90. By the coin C landing and staying on the plate 90, the user can prove to the proprietor of the apparatus 10 that the target 30 was made in case a prize is offered to users for making-the target. The coin C will drop off the plate 90 and continue downwardly along the path 82 toward and into the coin deposit slot 40, resulting in the dispensing of the vendable item B to the user upon rotation of the knob 46 of the coin deposit by the user, only when the user intentionally rotates the elongated member 88 and thereby pivots the plate 90. The user will obtain the vendable item, such as the gum ball B, whether the target 30 is made or missed so long as the proper coin is used. Upon release of the elongated member 88 of the mechanism 34, the plate 90 due to the offset relationship of its pivot axis P relative to a longitudinal centerline L of the plate 90 will return automatically to its horizontal blocking position across the path 82 of the coin through the target 30.

Foreign Object Removal-Enabling Means

As mentioned above, mischievous users from time to time have caused problems by attempting to play the game module without paying with a coin to play. These users typically will insert unauthorized foreign objects, such as folded piece of papers or the like instead of coins, through the horizontal portion 60B of the slot 60 in the front wall 54 of the game module housing 28 of the apparatus housing 35. The foreign objects will accumulate in the lower end portion 28B of the housing 28 and block passage of coins to slot 40 of the coin deposit 18, effectively disabling the apparatus 10 from use by legitimate users.

Figure 5:
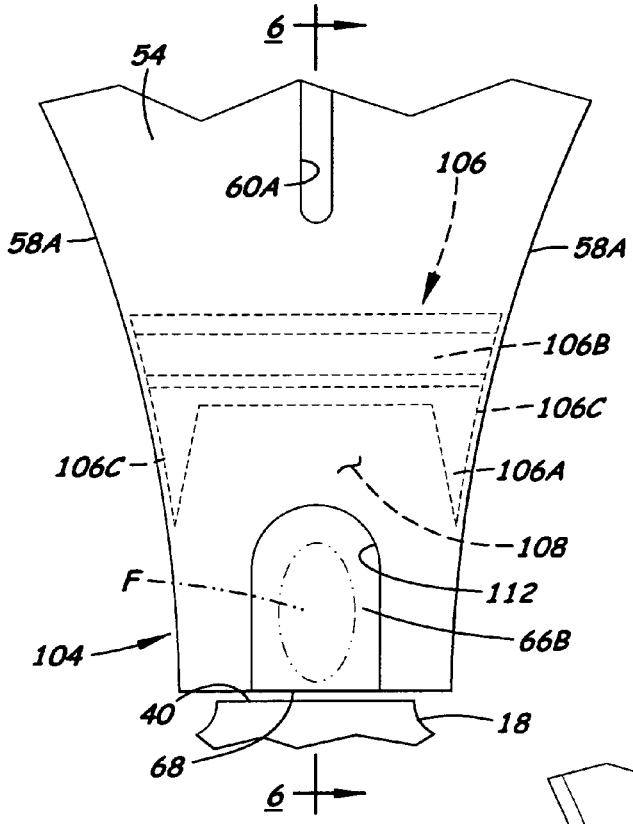
FIG. 5 is an enlarged fragmentary front elevational view of the game module housing of the apparatus having the foreign object removal-enabling features of the present invention incorporated by a funnel-shaped lower end portion of the housing.
Figure 6:
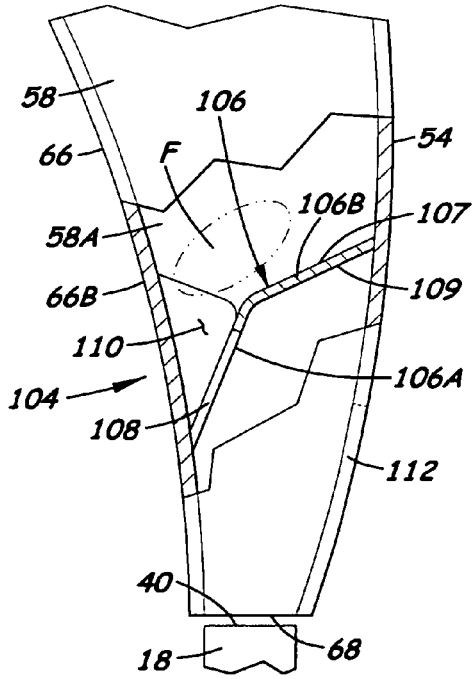
FIG. 6 is a fragmentary vertical sectional view of the game module housing of the apparatus as seen along line 6-6 of FIG. 5 showing the foreign object removal-enabling features incorporated by the lower end portion of the housing.

Turning now to FIGS. 5 and 6, there is illustrated a means, generally designated 104, for enabling removal of a foreign object from the apparatus housing 35. The removal-enabling means 104 is provided on the apparatus housing 35, and, more particularly, on its game module housing 28, so as to facilitate convenient and easy access to any foreign object F therein so that the obstructing foreign object may be removed without the necessity to disassemble the globe 22 and game module housing 28, making up the apparatus housing 35, from the support base 16.

To order to prevent foreign objects F from reaching the region of the coin deposit 18, the foreign object removal-enabling means 104 provides a first element in the form of an angled guard wall 106, preferably, although not necessarily, of shallow V-shaped configuration in cross-section. The guard wall 106 is disposed across the funnel-shaped lower end portion 28B of the housing 28 between and connected to the curved bottom wall 66 and front wall 54 of the housing 28. The guard wall 106 has a generally upright lower segment 106A and a forwardly and upwardly inclined upper segment 106B merging from the lower segment 106A. Also, a pathway slot 108, longer horizontally than vertically, is defined in the lower segment 106A of the guard wall 106 that communicates with the bottom wall 66 so as to provide a path of travel through the guard wall 106, from an upstream side 107 to a downstream side 109 thereof, to the slot 40 of the coin deposit 18 for the coin sliding down the bottom wall 66. Lower portions 58A of the side walls 58 of the housing 28 are curved and converge toward one another and the opposite lateral ends 106C of the guard wall 106 are disposed adjacent to these lower curved convergent side wall portions 58A such that the only past the guard wall 106 to the slot 68 is through its pathway slot 108.

In order to remove from the interior cavity 64 of the housing 28 those foreign objects F stopped by the guard wall 106, the foreign object removal-enabling means 104 further provides one or more second elements in the form of side access openings 110 defined in the curved convergent lower portions 58A of housing side walls 58 adjacent opposite lateral ends 106C of the guard wall 106. The side access openings 110 can be generally triangular in shape although other shapes are possible. The largest dimension of the openings 110 is less than the diameter of the coin C such that the coin C cannot be withdrawn from the interior cavity 64 of the housing 28 through these openings 110.

It is expected that the location of the guard wall 106 will be likely to prevent any foreign object F inserted into the interior cavity 64 of the housing 28 through the lever slot 60 from traveling further past the guard wall 106 downwardly through the funnel-shaped portion of the lower end portion 28B of the housing 28 to the vicinity of the slot 68 at the terminal end thereof and of the slot 40 of the coin deposit 18. However, if the unexpected should happen and the foreign object pass through the pathway slot 108 of the guard wall 106, the foreign object removal-enabling means 104 further provides a third element in the form of a front access opening 112 defined in the front wall 56 of the housing 28 adjacent to and opening exteriorly to the front and downwardly contiguous with the slot 68 at the terminal end of the lower end portion 28B of the housing 28. The front access opening 112 is generally semi-oblong in shape being slightly greater in vertical height than horizontal width and the slot 68 is substantially greater in length than is the front access opening 112 in width such that a coin intended to be used to operate the coin deposit 18 cannot be removed through the front access opening 112.

The experience has been that all foreign objects F that are found within the region of the lower end portion 28B of the housing 28 are made of bendable or foldable material. So a person seeking to removal such objects through the side or front openings 110, 112 can make use of an ordinary pair of tweezers, or similar tools, to carry out the obvious and simple removal steps of, first, inserting the working end of the tweezers through the respective opening 110 or 112, next, gripping the foreign object and perhaps rotating the tweezers to wrap the foreign object therearound if found necessary, and then pulling or withdrawing the tweezers with the foreign object out through the opening 110 or 112.

It should be understood that the foreign object removal-enabling means 104 is not limited in its application just to the housing 28 of the particular game module 14 disclosed herein. The game module 14 could take many other alternative designs without diminishing the general utility and applicability of the afore-described elements of the foreign object removal-enabling means 104 as a workable solution should the same problem arise in the case of the housings of such other game modules. Furthermore, it should be understood that the scope of the present invention is not limited to foreign object removal-enabling means 104 having the specific design of the gate wall 106 and the side and front access openings 110, 112 but encompasses elements having other configurations which solve the same problem in a similar way.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A game module for a coin-operated item vending machine, said game module comprising:

(a) a housing including a lower housing portion and one slot defined in said lower housing portion for permitting discharge of the coin from said housing; and (b) means for enabling removal of a foreign object from within said housing, said removal-enabling means including (i) a guard wall positioned within said housing above said one slot and extending across a path of travel of the coin to said one slot such that said guard wall can stop a foreign object from traveling on a portion of said path of travel from an upstream side to a downstream side of said guard wall and therefrom to said one slot, said guard wall also including another slot having a maximum dimension greater than a maximum dimension of the coin for permitting the coin to pass through said guard wall from said upstream side to said downstream side thereof and therefrom to said one slot, and (ii) at least one opening defined in said housing adjacent one end of said guard wall and said upstream side of said guard wall such that said one opening will permit withdrawal of the foreign object from said housing, said one opening having a maximum dimension less than the maximum dimension of the coin such that the coin cannot be withdrawn from said housing through said one opening.

2. The game module of claim 1 wherein said guard wall has a generally upright lower segment and a forwardly and upwardly inclined upper segment merging from said lower segment.

3. The game module of claim 2 wherein said another slot is defined in said upright lower segment of said guard wall.

4. The game module of claim 1 wherein said lower and upper segments of said guard wall together define a shallow V-shaped angular configuration in cross-section.

5. The game module of claim 1 wherein said housing has multiple walls define a funnel-shaped configuration, said guard wall extending across and interconnecting said multiple walls.

6. The game module of claim 1 wherein said housing has a pair of spaced apart opposite side walls, said guard wall extending between and connected at opposite ends to said side walls.

7. The game module of claim 6 wherein said one opening is defined in one of said side walls of said housing.

8. The game module of claim 6 wherein said removal-enabling means includes another opening, said one and another openings being each defined in one of said side walls of said housing.

9. The game module of claim 1 wherein said removal-enabling means further includes a second opening in said housing below and spaced from said downstream side of said guard wall such that said second opening permits withdrawal of a foreign object from said housing which passed through said another slot in said guard wall.

10. The game module of claim 9 wherein said housing has multiple walls defining a funnel-shaped configuration, said guard wall extending across and interconnecting said multiple walls, said second opening being defined in one of said multiple walls spaced from and at least partially below said guard wall.

11. A game module for a coin-operated item vending machine, said game module comprising:

(a) a housing including (i) an upper housing portion, (ii) a first slot defined in said upper housing portion for permitting entry of a coin of a predetermined size into said housing, (iii) a lower housing portion, and (iv) a second slot defined in said lower housing portion spaced below said first slot for permitting discharge of the coin from said housing after the coin has traversed within said housing along a path of travel from said first slot to said second slot; and (b) means for enabling removal of a foreign object from within said housing, said removal-enabling means including (i) a guard wall positioned within said housing below said first slot and above said second slot and extending across said path of travel of the coin such that said guard wall can stop a foreign object from traveling on a portion of said path of travel from an upstream side to a downstream side of said guard wall and therefrom to said second slot, said guard wall also including a third slot having a maximum dimension greater than a maximum dimension of the coin for permitting the coin to pass through said guard wall from said upstream side to said downstream side thereof and therefrom to said second slot, and (ii) at least one first opening defined in said housing adjacent one end of said guard wall and said upstream side of said guard wall such that said first opening will permit withdrawal of the foreign object from said housing, said first opening having a maximum dimension less than the maximum dimension of the coin such that the coin cannot be withdrawn from said housing through said first opening.

12. The game module of claim 11 wherein said guard wall has a generally upright lower segment and a forwardly and upwardly inclined upper segment merging from said lower segment.

13. The game module of claim 12 wherein said third slot is defined in said upright lower segment of said guard wall.

14. The game module of claim 11 wherein said lower and upper segments of said guard wall together define a shallow V-shaped angular configuration in cross-section.

15. The game module of claim 11 wherein said lower housing portion has multiple walls define a funnel-shaped configuration, said guard wall extending across and interconnecting said multiple walls.

16. The game module of claim 11 wherein said lower housing portion has a pair of spaced apart opposite side walls, said guard wall extending between and connected at opposite ends to said side walls.

17. The game module of claim 16 wherein said at least one first opening is defined in one of said side walls of said housing.

18. The game module of claim 16 wherein said removal-enabling means includes a pair of said first openings each defined in one of said side walls of said housing.

19. The game module of claim 11 wherein said removal-enabling means further includes a second opening in said housing below and spaced from said downstream side of said guard wall such that said second opening permits withdrawal of a foreign object from said housing which passed through said third slot in said guard wall.

20. The game module of claim 19 wherein said lower housing portion has multiple walls defining a funnel-shaped configuration, said guard wall extending across and interconnecting said multiple walls, said second opening being defined in one of said multiple walls spaced from and at least partially below said guard wall.

* * * * *